United States Patent [19]

Sato et al.

[11] Patent Number: 4,843,195

[45] Date of Patent: Jun. 27, 1989

[54] SWITCH HAVING DUST-PROOF COVER

[75] Inventors: Hiroyuki Sato; Yujiro Shimoyama, both of Furukawa, Japan

[73] Assignee: Alps Electric Co., Ltd., Japan

[21] Appl. No.: 160,702

[22] Filed: Feb. 26, 1988

[30] Foreign Application Priority Data

Jun. 2, 1987 [JP] Japan ..... 62-85495

[51] Int. Cl.[4] ..... H01H 21/08

[52] U.S. Cl. ..... 200/302.3; 200/339

[58] Field of Search ..... 200/302.2, 339, 68.1, 200/68.2

[56] References Cited

U.S. PATENT DOCUMENTS

| | | | |
|---|---|---|---|
| 3,742,171 | 6/1973 | Howe | 200/302.3 |
| 4,319,107 | 3/1982 | Haskins | 200/339 |
| 4,340,791 | 7/1982 | Sorenson | 200/339 X |

FOREIGN PATENT DOCUMENTS

| | | | |
|---|---|---|---|
| 1127436 | 5/1957 | Fed. Rep. of Germany | 200/302.3 |
| 3538849 | 4/1986 | Fed. Rep. of Germany | 200/302.3 |

*Primary Examiner*—Renee S. Luebke

*Attorney, Agent, or Firm*—Guy W. Shoup; Paul J. Winters; Norman R. Klivans

[57] ABSTRACT

A switch device which can surely prevent introduction of foreign articles past an opening at the top of a case without employing a cover made of a rubber material. The switch device includes a cover made of a synthetic resin material and mounted at the top of a casing on which a switch operating member is supported for pivotal motion and within which a conductor plate is mounted for rocking motion such that a tilting motion of the switch operating member will cause rocking motion of the conductor plate to make a switching operation of the switch device. The cover has an opening formed therein through which the switch operating member extends downwardly into the inside of the casing, and a pair of downwardly extending projected walls are formed on opposite peripheral edges of the opening of the cover while the switch operating member has a pair of semicylindrical flanges formed thereon which extend in a curve centered at the axis of pivotal motion of the switch operating member and are opposed to and engaged at upper faces thereof with the projected walls of the cover.

2 Claims, 2 Drawing Sheets

SWITCH HAVING DUST-PROOF COVER

BACKGROUND OF THE INVENTION

This invention relates to a switch device of the seesaw type wherein a switch operating member is tilted to cause switching of the switch device, and more particularly to a dust proof structure of such a switch device.

Switch devices of such a seesaw type as mentioned above are used in various fields. Where such a switch device is used for an application in which it is relatively frequently exposed to dust, for example, for a power window for a car, a dust proof structure is required for the switch device in order to prevent dust from entering to a contact of the switch.

An exemplary one of known dust proof structures includes a thin cover of a rubber material which covers over a location near a support shaft for a switch operating member and an upper portion of a case in such a manner as to prevent foreign articles such as dust or water from entering from an opening portion in an upper wall of the case.

With such a switch device which employs a cover made of rubber as described above, the rubber cover is resiliently deformed following a tilting motion of a switch operating member. Accordingly, an opening defined between the switch operating member and a case can be closed with certainty by the rubber cover. However, since the rubber cover is made of a soft material, it is difficult to assemble it using an automated material employing a vacuum attracting means or a chucking means. Accordingly, there is a disadvantage that a cover must necessarily be assembled exclusively by manual operation.

SUMMARY OF THE INVENTION

Accordingly, it is an object of the present invention to provide a switch device which eliminates the drawback of the prior art switch device described above and can surely prevent introduction of foreign articles past an opening at the top of a case without employing a cover made of a rubber material.

In order to attain the object, according to the present invention, there is provided a switch device which comprises a casing having an opening formed at the top thereof, a switch operating member supported for pivotal motion on the casing and extending downwardly through the opening of the casing into the inside of the casing, a conductor plate mounted for rocking motion within the casing and located such that a tilting motion of the switch operating member will cause rocking motion of the conductor plate to make a switching operation of the switch device, and a cover made of a synthetic resin material and mounted at the top of the case, the cover having an opening formed therein through which the switch operating member extends downwardly into the inside of the casing, the cover having a pair of downwardly extending projected walls formed on opposite peripheral edges of the opening thereof in the direction of rocking motion of the switch operating member, the switch operating member having a pair of semi-cylindrical flanges formed thereon which extend in a curve centered at the axis of pivotal motion of the switch operating member and are opposed to and engaged at upper faces thereof with the projected walls of the cover.

With the construction described above, most of the opening at the top of the case is closed by the cover made of a synthetic resin material, and the gap which is required between the inner periphery of the opening of the cover and the operating member is closed by the depending projected wall formed on the cover and the circumferential face of the flange provided on the switch operating member. Here, since the flange provides a circumferential face extending around the pivot shaft of the switch operating member, the mutually engaging condition between the projected wall and the flange is assured irrespective of a pivoted position of the switch operating member so that foreign articles such as dust are not introduced into the interior of the case. Thus, according to the present invention, a switch device having a high dust proof effect can be provided without using a cover made of a rubber material.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
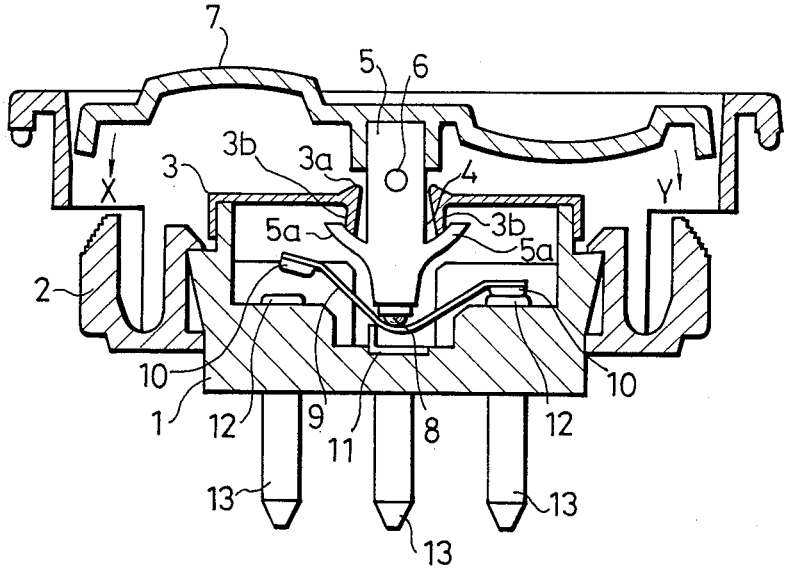
FIG. 1 is a cross sectional view of a switch device in a neutral position showing a preferred embodiment of the present invention.
Figure 2:
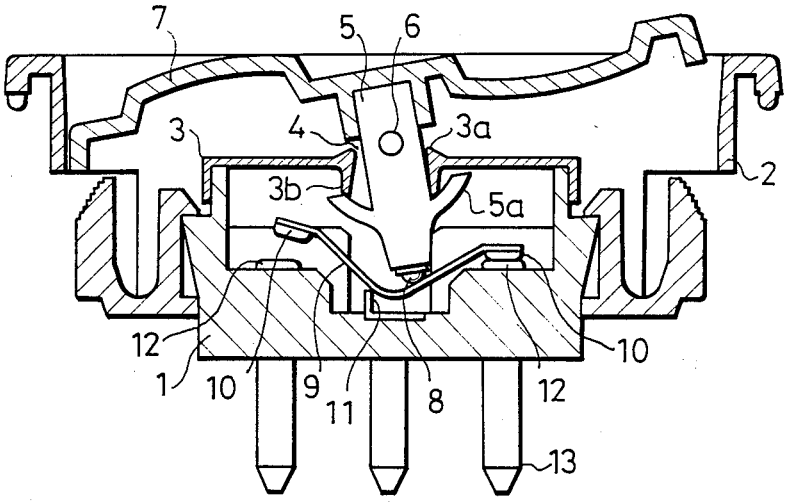
FIGS. 2 and 3 are cross sectional views showing the switch device of FIG. 1 in different operating conditions.
Figure 3:
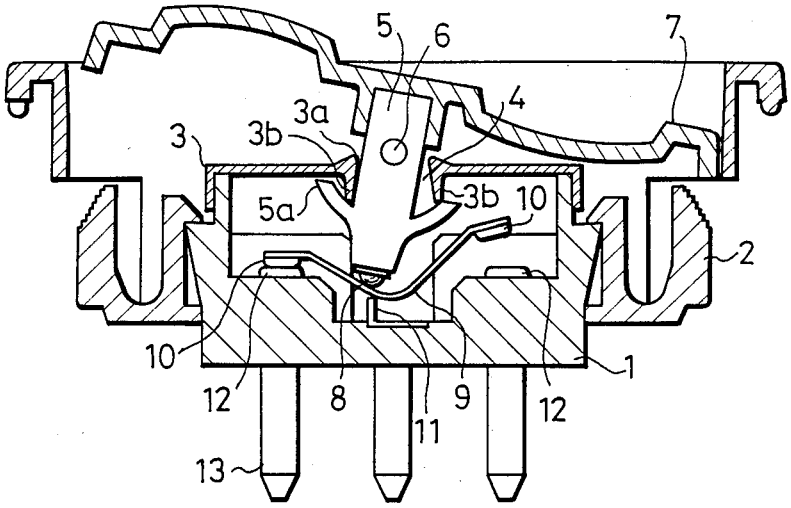

Referring to FIGS. 1 to 3 which show a switch device embodying the present invention, the switch device shown includes an inner case 1 having an opening at the top thereof, and an outer case 2 snap-coupled in an integral relationship to the inner case 1. A cover 3 made of a synthetic resin material is securely mounted at the top of the inner case 1 by a suitable fixing means such as snap-coupling. The cover 3 has an opening 4 perforated at a central location thereof, and a pair of upwardly extending swollen portions or ribs 3*a* and a pair of downwardly extending projected walls or ribs 3*b* are formed in a contiguous relationship on opposite edges of an inner periphery of the opening 4 of the cover 3.

The switch device further includes a switch operating member 5 supported for pivotal motion at an upper portion of the inner case 1 by means of a pin 6, and a pressing member 7 securely mounted at the top of the switch operating member 5. The switch operating member 5 extends downwardly through the opening 4 of the cover 3 to the inside of the inner case 1. The switch operating member 5 has formed in an integral relationship on opposite sides thereof in the direction of pivotal motion a pair of semi-cylindrical flanges 5*a* which extend along a curve centered at the pin 6, and upper faces of the flanges 5*a* are held in abutting engagement with lower ends of the projected walls 3*b* of the cover 3 as seen in FIG. 1. An actuator bar 8 is accommodated in the inside of the switch operating member 5 with a spring not shown interposed therebetween such that a lower end thereof is held in resilient contact with an upper face of a conductor plate 9.

The conductor plate 9 is bent in such a manner as to provide a generally V-shaped side elevation as seen in FIG. 1 and has a pair of movable contacts 10 mounted at longitudinal opposite ends thereof. The conductor plate 9 is supported at a longitudinal intermediate portion of one of two arms of the V-shape thereof for rocking motion at an upper end of a central terminal 11.

It is to be noted that a second conductor plate (not shown) similar to conductor plate 9 is provided adjacent to conductor plate 9. The second conductor plate, like conductor plate 9, is V-shaped and supported at one of the arms of the V by a means not shown. The second conductor plate moves opposite to the first conductor plate 9, as described below. Fixed contacts 12 are provided corresponding to the movable contacts 10 and the central terminals 11 on an inner face of a bottom wall of the inner case 1, and terminals 13 electrically connected to the fixed contacts 12 and the central terminals 11 are mounted on and extend downwardly through and from the bottom wall of the inner case 1.

Now, operation of the switch device of the embodiment described above will be described.

When no pressing force is applied to the pressing member 7, the switch operating member 5 assumes a neutral position as shown in FIG. 1 in which the actuator bars 8 resiliently contact with portions of the conductor plates 9 at or near the V-shaped bent bottoms. In this instance, the conductor plate 9 shown is positioned such that one of the movable contacts 10 which is shown located at the right end of the conductor plate 9 in FIG. 1 is held in contact with the corresponding fixed contact 12 while the other movable contact 10 is spaced away from the corresponding fixed contact 12 as seen in FIG. 1, but the other conductor plate not shown in FIG. 1 is positioned on the contrary such that the leftwardly located movable contact is held in contact with the corresponding fixed contact while the other rightwardly located movable contact is spaced away from the corresponding fixed contact.

If the pressing member 7 is pushed in the direction of an arrow marked X in FIG. 1 from the neutral position, the switch operating member 5 is pivoted in the same direction around a fulcrum provided by the pin 6 as shown in FIG. 2 whereupon the actuator bars 8 are slidably removed on the inclined faces of the conductor plates 9 under the urging forces of the springs not shown. In this instance, the conductor plate 9 shown is not rocked and maintains its position wherein the rightwardly located movable contact 10 is held in contact with the opposing fixed contact 12 as seen in FIG. 2 while the other conductor plate not shown is rocked in the clockwise direction in FIG. 1 because the actuator bar on the corresponding switch operating member 5 moves past the corresponding central terminal which provides the fulcrum for rocking motion to the conductor plate. Consequently, the leftwardly located movable contact on the conductor plate is brought out of contact with the corresponding fixed contact while the rightwardly located movable contact on the conductor plate is brought into contact with the corresponding fixed contact, thereby causing switching of the switch device.

On the contrary, if the pressing member 7 is pushed in the direction indicated by an arrow marked Y in FIG. 1 from the neutral position, the switch operating member 5 is pivoted in the same direction around the fulcrum provided by the pin 6 as shown in FIG. 3. In this instance, the conductor plate shown is rocked in the counterclockwise direction in FIG. 1 to cause switching of the switch device because the corresponding actuator bar 8 moves past the central terminal 11 which provides the fulcrum for rocking motion to the conductor plate 9 while the other conductor plate not shown is not rocked and maintains its position in which only the leftwardly located movable contact is held in contact with the corresponding fixed contact.

Upon such switching operation of the switch device as described above, the switch operating member 5 is pivoted within the range of the opening 4 of the cover 3 around the fulcrum provided by the pin 6. In this instance, as clearly seen in the drawings, engagement between the projected walls **3*b* of the cover 3 and the flanges 5*a* of the switch operating member 5 is always assured irrespective of a pivoted position of the switch operating member 5. Accordingly, the projected walls 3*b* and the flanges 5*a* function as a dust proof wall for isolating the inside from the outside of the inner case. Accordingly, if some foreign articles such as dust should be introduced into the inside of the inner case 1 past a gap defined between the switch operating member 5 and the peripheral edges of the opening 4 of the cover 3, most of them will be intercepted by the projected walls 3*b* and the flanges 5*a* and will not enter the interior of the inner case 1. Consequently, there is little possibility of occurrence of incomplete contact between movable and fixed contacts of the switch device. Besides, in the present embodiment, since the upwardly projected swollen portions 3*a* are provided on the peripheral edges of the opening 4 of the cover 3, advancement of foreign articles into the opening 4 is checked by the swollen portions 3*a*. This enables provision to a switch device of a high dust proof property coupled with the dust proof effect by the projections 3*b* and the flanges 5*a*** described above.

Having now fully described the invention, it will be apparent to one of ordinary skill in the art that many changes and modifications can be made thereto without departing from the spirit and scope of the invention as set forth herein.

What is claimed is:

1. A switch device, comprising:

a casing having an opening, a switch operating member supported for pivotal motion on said casing and extending through said opening of said casing into the inside of said casing;

a conductor plate mounted for rocking motion within said casing and located such that a tilting motion of said switch operating member will cause rocking motion of said conductor place to make a switching operation of said switch device;

and a cover made of a synthetic resin material and mounted over said opening of said casing, said cover having an opening formed therein through which said switch operating member extends into the inside of said casing;

said cover having a pair of projected walls extending into said opening of said cover formed on opposite peripheral edges of said opening thereof in the direction of rocking motion of said switch operating member;

said switch operating member having a pair of semicylindrical flanges formed thereon which extend in a curve centered at an axis of pivotal motion of said switch operating member and are opposed to and engaged at concave faces thereof with said projected walls of said cover.

2. A switch device according to claim 1, wherein said cover further has a pair of swollen portions extending outwardly from said opening in said cover and formed in a contiguous relationship to said projected walls of said cover on opposite edges of said opening thereof.

* * * * *